US012053129B2

(12) United States Patent
Leach

(10) Patent No.: US 12,053,129 B2
(45) Date of Patent: Aug. 6, 2024

(54) FOOT SPA CONSTRUCT

(71) Applicant: Gulfstream Inc., Cambridge (CA)

(72) Inventor: Steven Leach, Cambridge (CA)

(73) Assignee: Gulfstream Inc., Cambridge (CA)

( * ) Notice: Subject to any disclaimer, the term of this patent is extended or adjusted under 35 U.S.C. 154(b) by 147 days.

(21) Appl. No.: 17/470,190

(22) Filed: Sep. 9, 2021

(65) Prior Publication Data

US 2022/0071455 A1 Mar. 10, 2022

Related U.S. Application Data

(60) Provisional application No. 63/076,000, filed on Sep. 9, 2020.

(51) Int. Cl.
*A47K 3/022* (2006.01)
*A47K 3/00* (2006.01)

(52) U.S. Cl.
CPC ..... *A47K 3/001* (2013.01); *A47K 3/022* (2013.01)

(58) Field of Classification Search
CPC .... A47K 1/06; A47K 11/04–08; A47K 3/002; A47K 3/004; A47K 3/022; A47K 3/024; A47K 3/06–074; A61H 35/00–04; E03C 1/186; E03C 1/244
See application file for complete search history.

(56) References Cited

U.S. PATENT DOCUMENTS 4,106,133 A * 8/1978 Roberts ..... A47K 3/022 4/655
5,153,950 A * 10/1992 Sowers ..... A47K 3/002 4/655
5,568,817 A * 10/1996 Harty ..... A61B 46/00 128/853
5,630,235 A * 5/1997 Angstadt ..... A47K 3/001 4/583
5,661,857 A * 9/1997 McLean ..... E03C 1/18 4/DIG. 18
5,742,955 A * 4/1998 Parkay ..... A47K 3/002 4/583
6,405,389 B1 * 6/2002 Harty ..... A61G 7/0005 4/621
8,959,674 B2 * 2/2015 Gellert ..... E03C 1/2302 4/688
9,439,831 B2 * 9/2016 Ta ..... A47K 3/022
10,513,840 B2 * 12/2019 Ta ..... E03C 1/24
10,808,386 B2 * 10/2020 Beck ..... E03C 1/14

* cited by examiner

*Primary Examiner* — David P Angwin
*Assistant Examiner* — Nicholas A Ros
(74) *Attorney, Agent, or Firm* — MaxGoLaw PLLC

(57) ABSTRACT

Arrangements for sealing a liner about the overflow aperture of a foot spa basin are provided. In one embodiment, a tube communicating with the overflow aperture and an annular, elastomeric seal are provided. In another embodiment, a vacuum is provided. In a third embodiment, an annular ring having suction cups adapted to releasably grip the basin is provided.

1 Claim, 13 Drawing Sheets

28

FOOT SPA CONSTRUCT

FIELD OF THE INVENTION

The invention relates to the field of foot spas.

BACKGROUND

Foot spas are widely used in the pedicure field.

It is commonplace for basin liners to be used, to improve hygiene and simplify sanitation.

However, the use of liners has complications since liners often occlude the basin overflow. This can result in spills.

SUMMARY OF THE INVENTION

Forming one aspect of the invention is apparatus for use with a foot spa basin liner, the apparatus includes a basin adapted to receive the liner, the basin having a bottom drain, a sidewall and an overflow aperture disposed in the sidewall. A means for sealing the liner about the overflow aperture.

According to another aspect of the invention, the means can be: a tube communicating with the overflow aperture and projecting interiorly of the basis; an annular, elastomeric seal adapted to grip about the tube; or a combination thereof.

According to another aspect of the invention, the means can be: a passage extending through the sidewall adjacent the overflow aperture; a vacuum in fluid communication with the passage; or a combination thereof.

Forming yet another embodiment of the invention is apparatus for use with a foot spa basin liner and a foot spa basin adapted to receive the liner, the basin having a bottom drain, a sidewall and an overflow aperture disposed in the sidewall, the apparatus including: an annular ring structure adapted to encircle the overflow aperture, the ring having two sides, one of the sides having one or more suction cups adapted to releasably grip the basin and, the other of the sides connected in use to the liner.

According to another aspect of the invention, the other of the sides can have an adhesive layer.

According to another aspect of the invention, the apparatus can further include a release layer which is removed to expose the adhesive layer.

Forming yet another aspect of the invention is apparatus for use with a foot spa basin, the basin having a bottom drain, a sidewall and an overflow aperture disposed in the sidewall, the apparatus including: a liner adapted to be received by the basin; an annular ring structure adapted to encircle the overflow aperture, the ring having two sides, one of the sides having one or more suction cups adapted to releasably grip the basin, the other of the two sides connected to the liner; or a combination thereof.

Advantages, features and characteristics of the invention will be evident upon a review of the following detailed description with reference to the appended drawings, the latter being briefly described below.

DETAILED DESCRIPTION

According to one aspect, the invention is an apparatus for use with a foot spa basin liner.

Figure 1A:
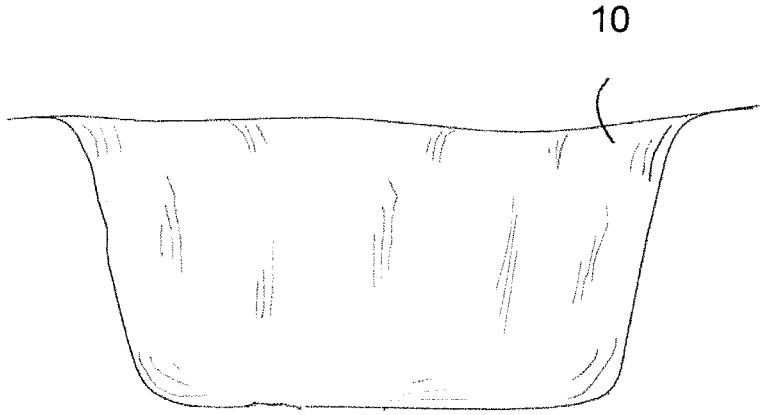
FIG. 1A PRIOR ART
FIG. 1A is a view of a prior art basin liner.

A foot spa basin liner of the prior art and in respect of which the invention can be used is shown in FIG. 1A and designated with reference numeral 10.

According to another aspect of the invention, the invention will be understood to comprise a basin.

Figure 1B:
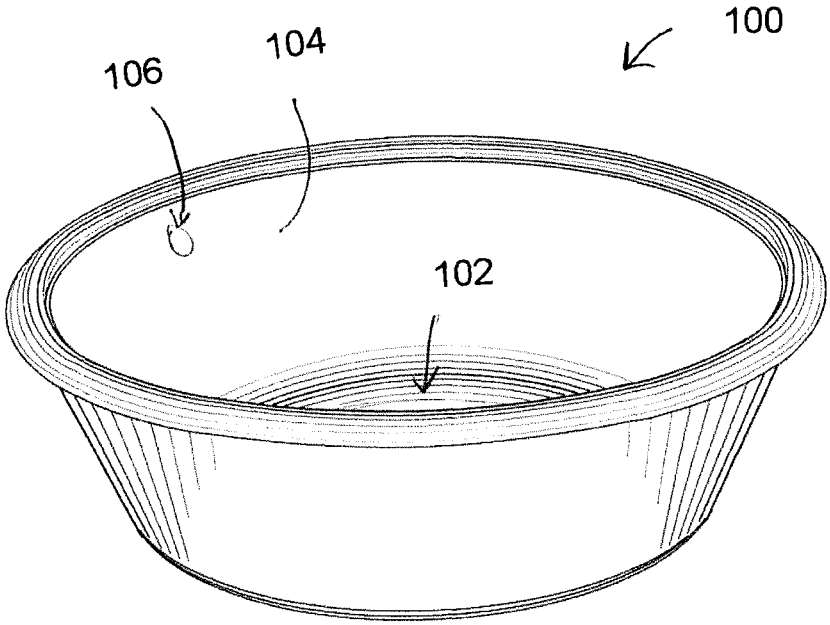
PRIOR ART FIG. 1B
FIG. 1B is a view of a prior art foot basin.
Figure 2:
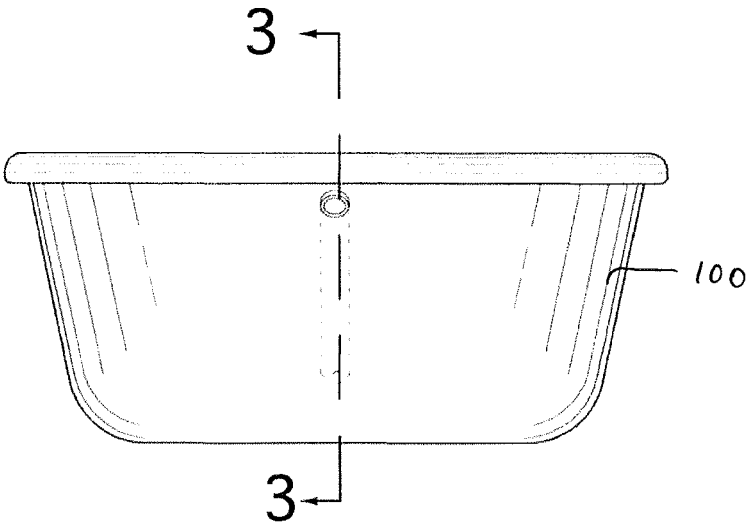
FIG. 2 is a side view of the basin of FIG. 1B.
Figure 3:
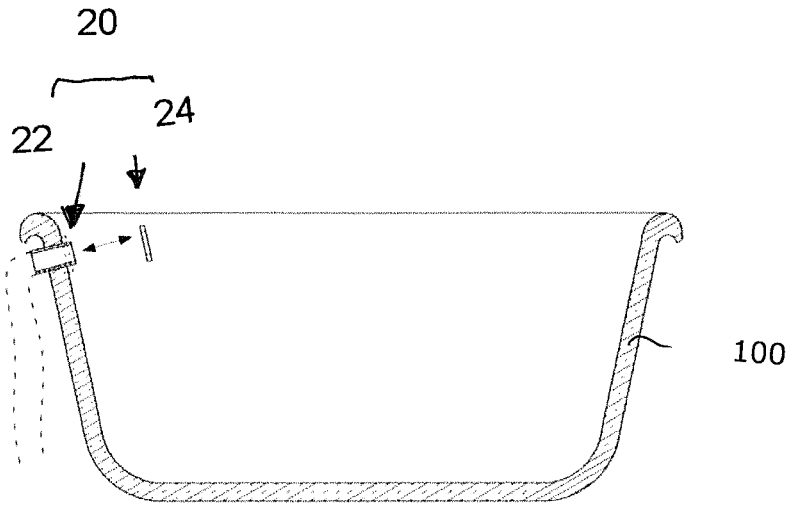
FIG. 3 is a view of an embodiment of the invention that includes the structure of FIG. 1B shown along 3-3.

A prior art basin is shown in FIG. 1B and designated with reference numeral 100 and will be understood to be adapted to receive the liner 10 and to have a bottom drain 102, a sidewall 104 and an overflow aperture 106 disposed in the sidewall.

This prior art basin 100 forms, along with a sealing means 20, one embodiment of the invention, as shown in FIG. 3-7. In this embodiment, the sealing means 20 is for sealing the liner about the overflow aperture and comprises a tube 22 and a seal 24.

The tube 22 communicates with the overflow aperture and projects interiorly of the basin 100.

The seal is annular and elastomeric and adapted to grip about the tube.

Figure 4:
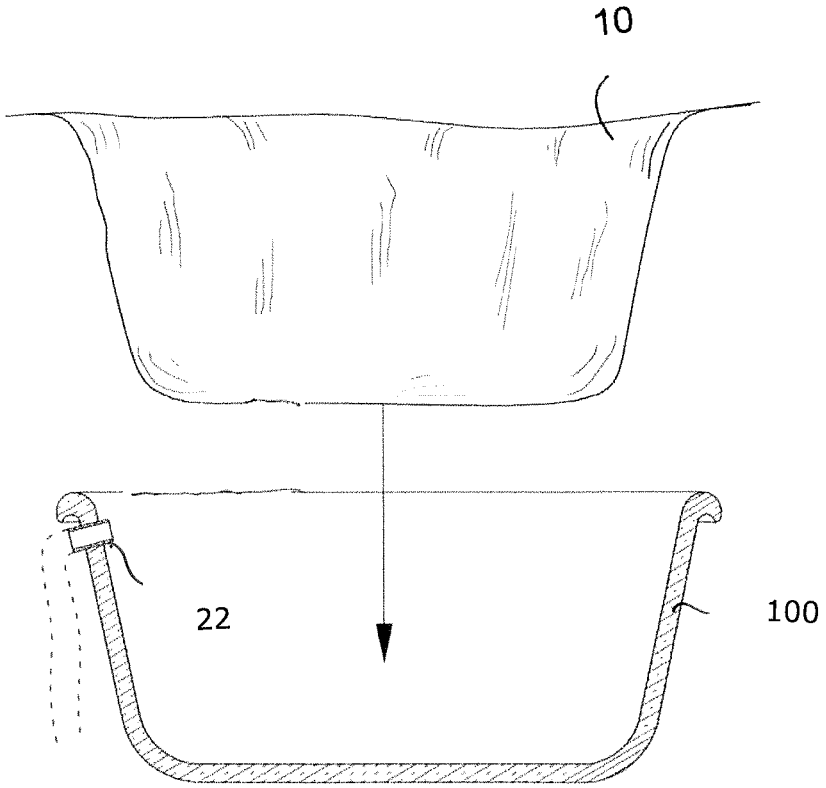
FIG. 4 is a view of the structure of FIG. 3 and the structure of FIG. 1A.
Figure 5:
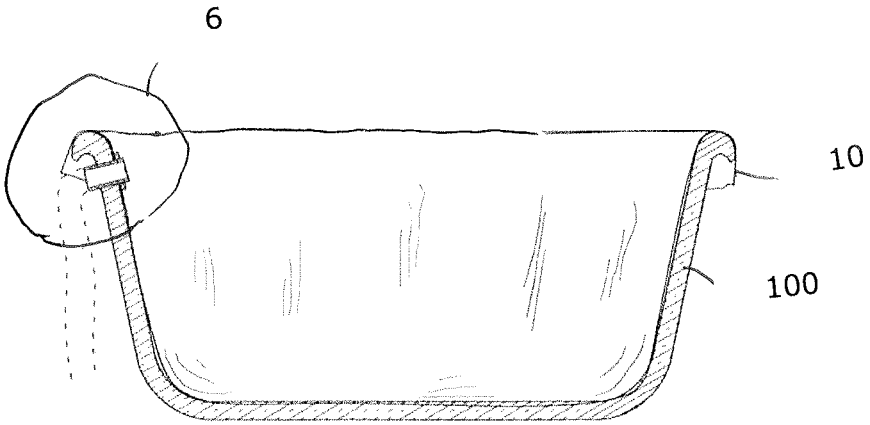
FIG. 5 is a view of the structure of FIG. 4 assembled for use.
Figure 6:
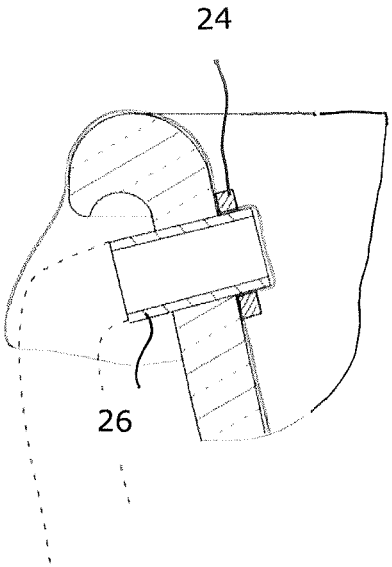
FIG. 6 is an enlarged view of the structure of encircled area 6 in FIG. 5.
Figure 7:
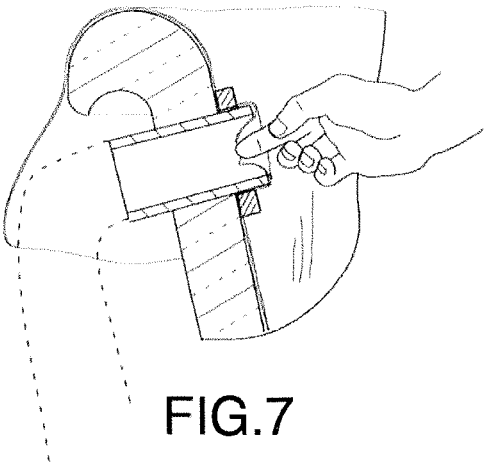
FIG. 7 is a view of the structure of FIG. 6 in the process of being punctured.
Figure 8:
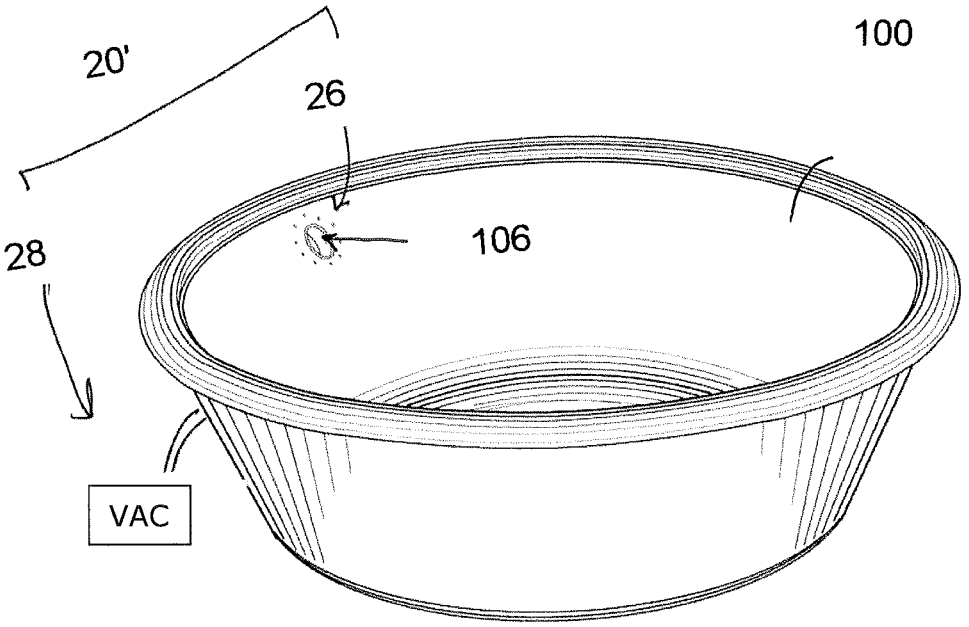
FIG. 8 is a view of another embodiment of the invention.
Figure 9:
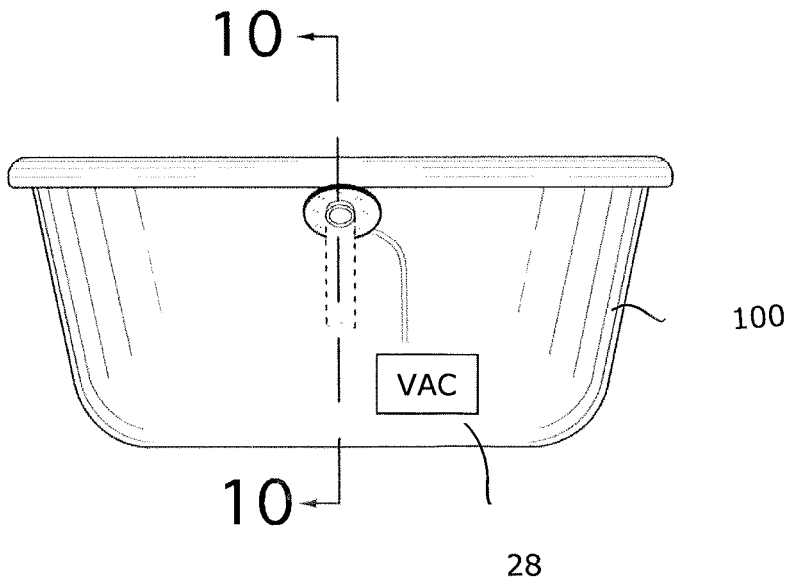
FIG. 9 is a side view of the structure of FIG. 8.
Figure 10:
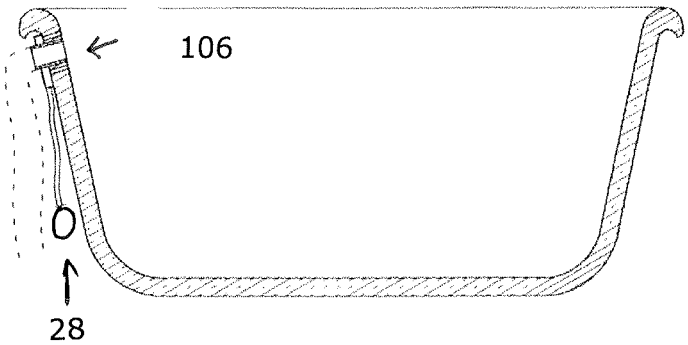
FIG. 10 is a view along 10-10 of FIG. 9.

In use, the liner is placed in the basin as shown in FIG. 4, the seal is fitted around the tube as shown in FIG. 5 and the overflow drain is popped with a finger or the like as shown in FIG. 7.

Another embodiment of the invention is shown in FIGS. 8-14.

In this embodiment, a modified sealing means 20' is provided, along with the basin of FIG. 1B. Here, the sealing means 20' seals the liner about the overflow aperture via a plurality of passages 26 and a vacuum 28.

The passages 26 extend through the sidewall of the basin 100 adjacent the overflow aperture 106.

The vacuum 28 is in fluid communication with the passages 26.

Figure 11:
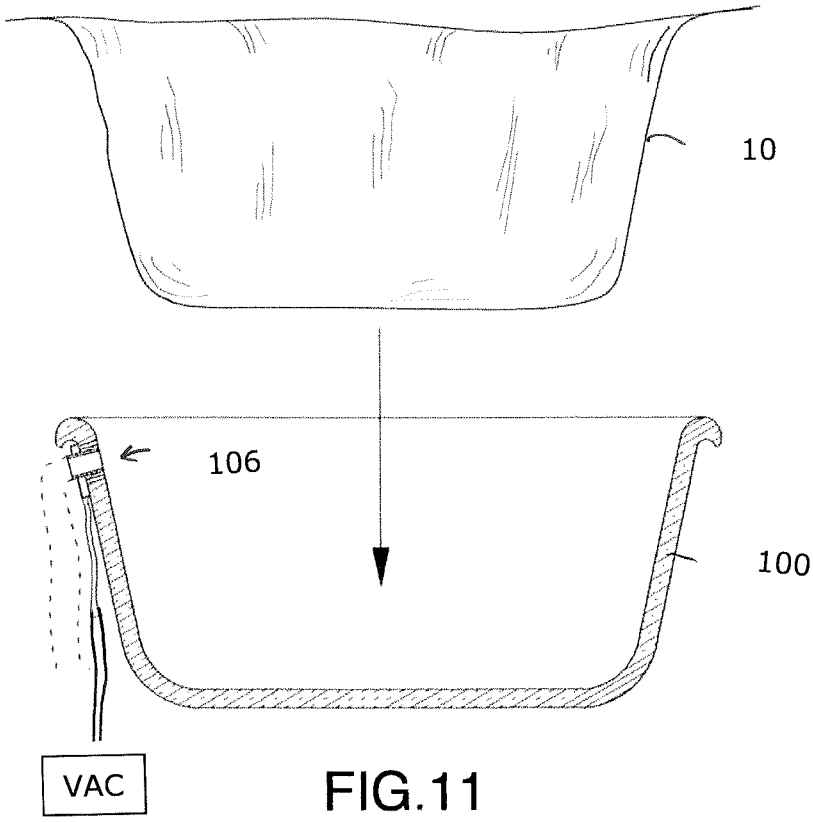
FIG. 11 is a view of the structure of FIG. 10 and the structure of FIG. 1A.
Figure 12:
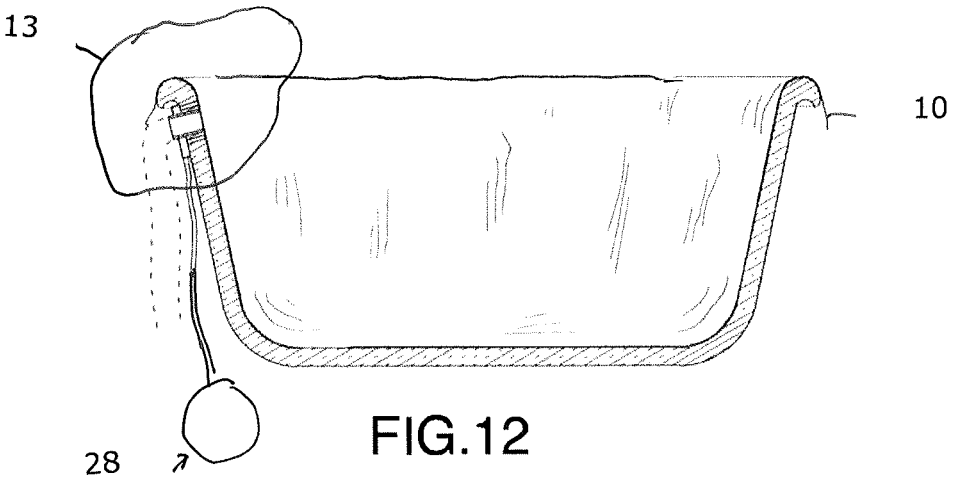
FIG. 12 is a view of the structure of FIG. 11 assembled for use.
Figure 13:
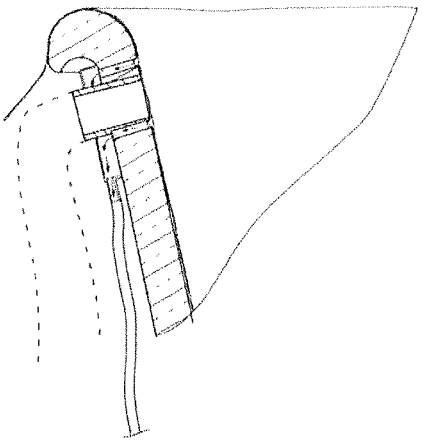
FIG. 13 is an enlarged view of the structure of encircled area 13 in FIG. 12.
Figure 14:
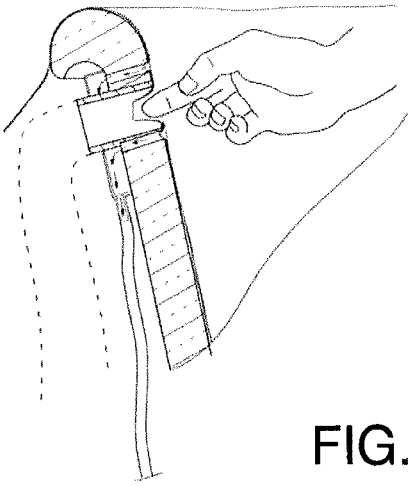
FIG. 14 is a view of the structure of FIG. 13 in the process of being punctured.
Figure 15:
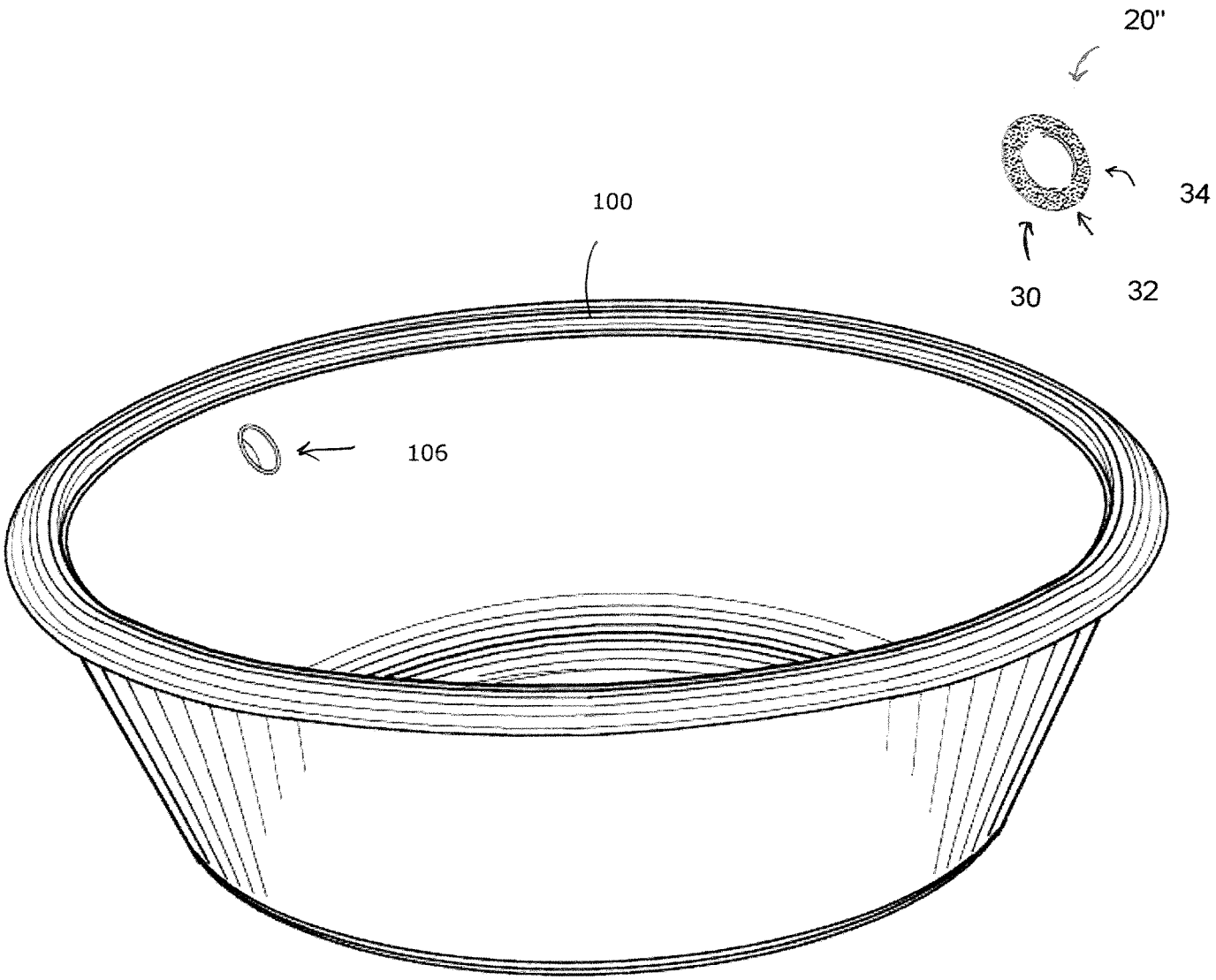
FIG. 15 is a view of another embodiment of the invention in combination with the structure of FIG. 1B.

In use, the liner 10 is placed in the basin 100 as indicated by FIG. 11, the vacuum 28 is activated to seal the liner against the basin and the overflow drain is popped with a finger or the like, as indicated by FIG. 14.

A further embodiment of the invention is shown in FIGS. 15-20 in combination with the basin 100 of FIG. 1B. In this embodiment, an annular ring structure 20" is provided. This structure 20" is adapted to encircle the overflow aperture and has two sides, one of the sides 30 having one or more suction cups adapted to releasably grip the basin and the other of the sides having an adhesive layer 32 overlaid by a release layer 34. A suitable product for forming the suction cup side is that sold under the trademark ALIEN TAPE™.

Figure 16:
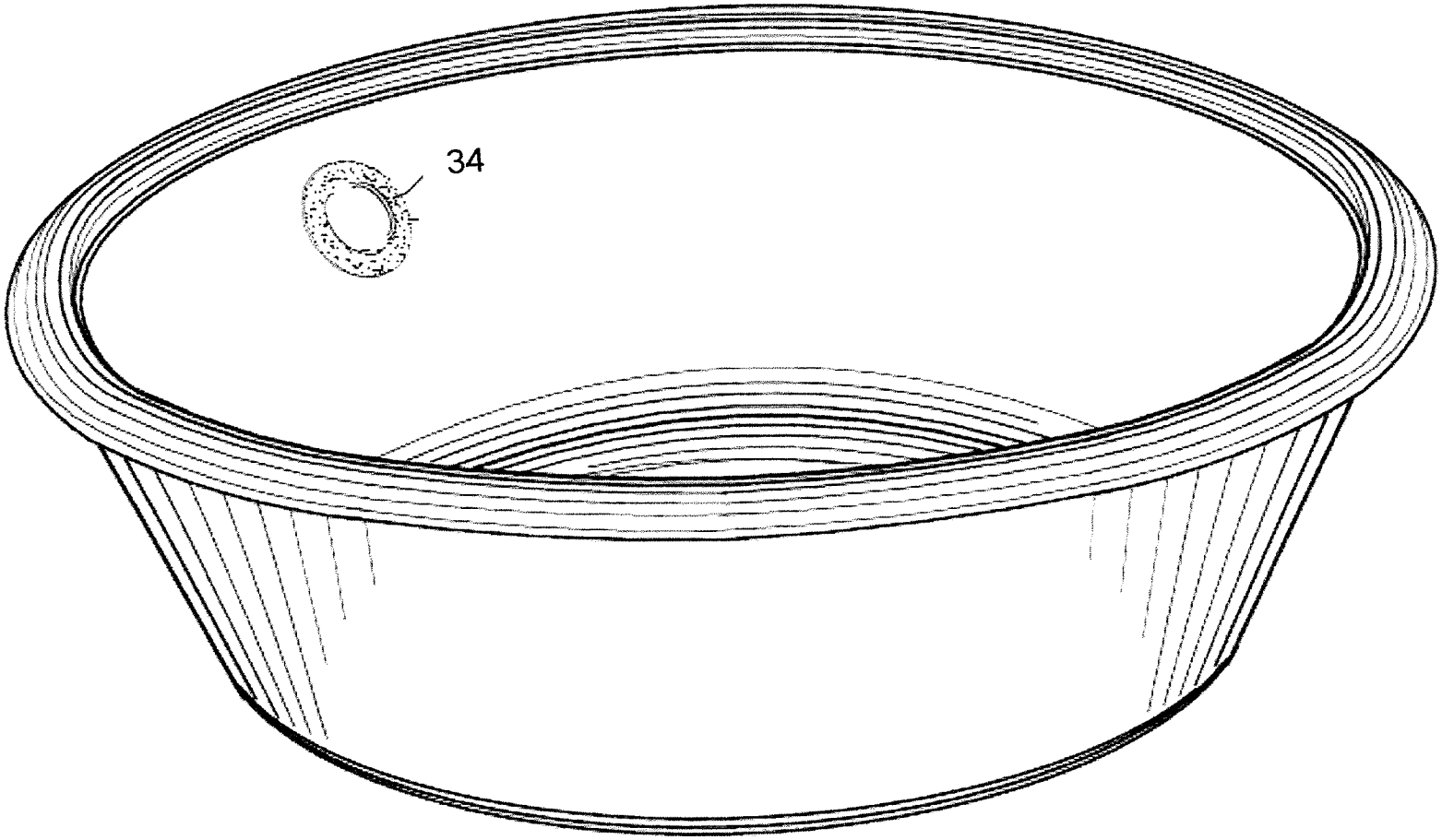
FIG. 16 is a view of the structure of FIG. 15 assembled for use.
Figure 17:
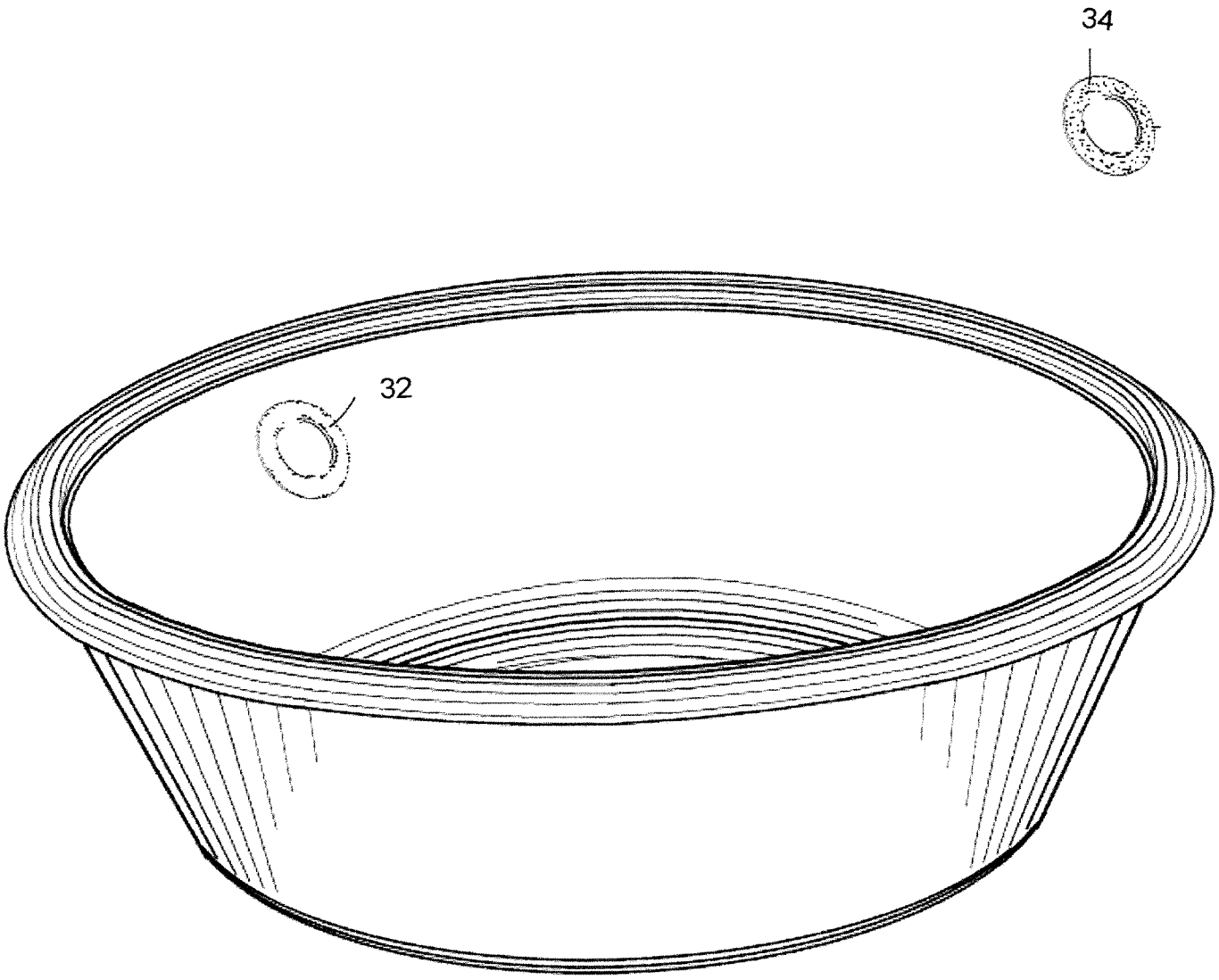
FIG. 17 is a view of the structure of FIG. 16 with a release layer removed.
Figure 18:
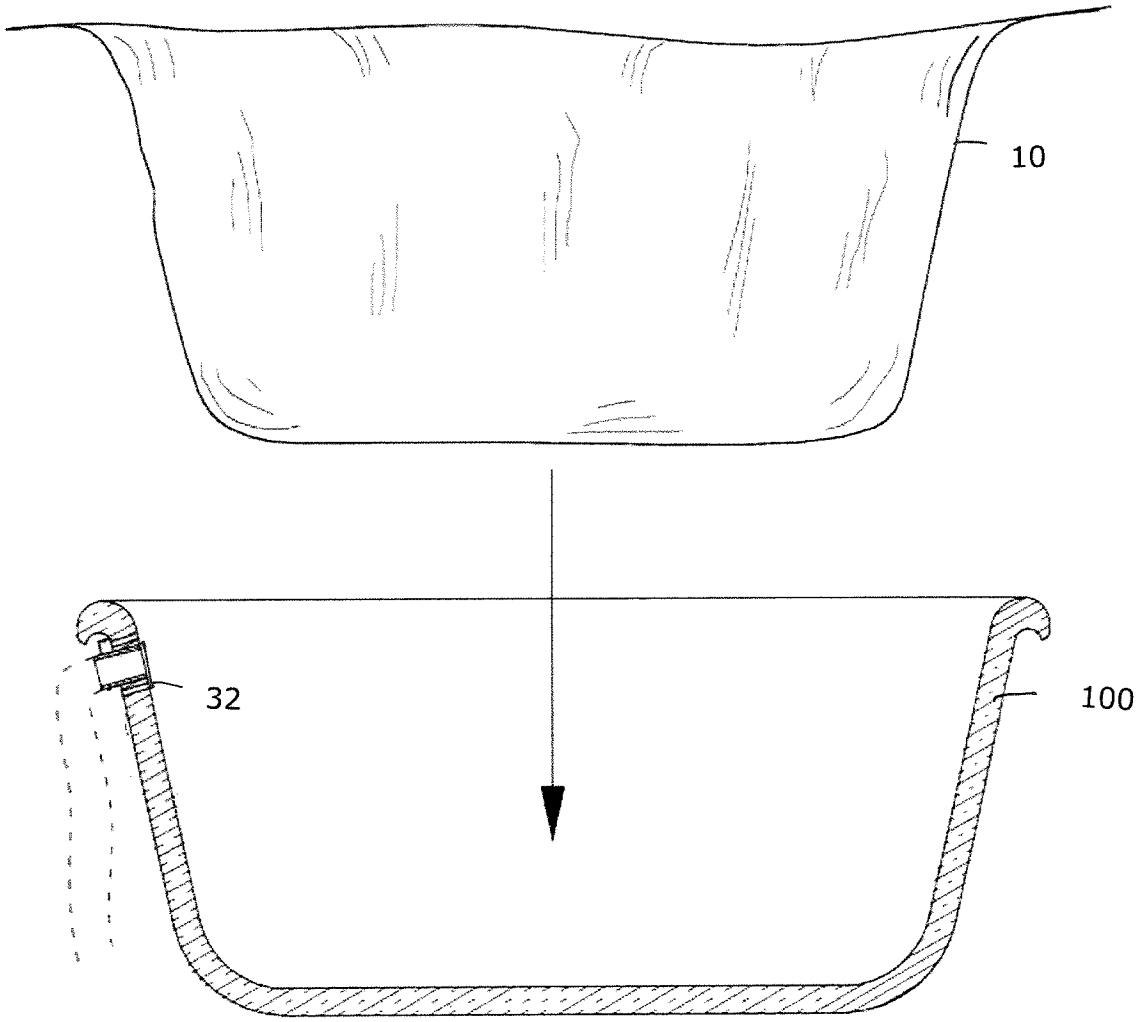
FIG. 18 is a view of the structure of FIG. 17 in combination with the structure of FIG. 1A.
Figure 19:
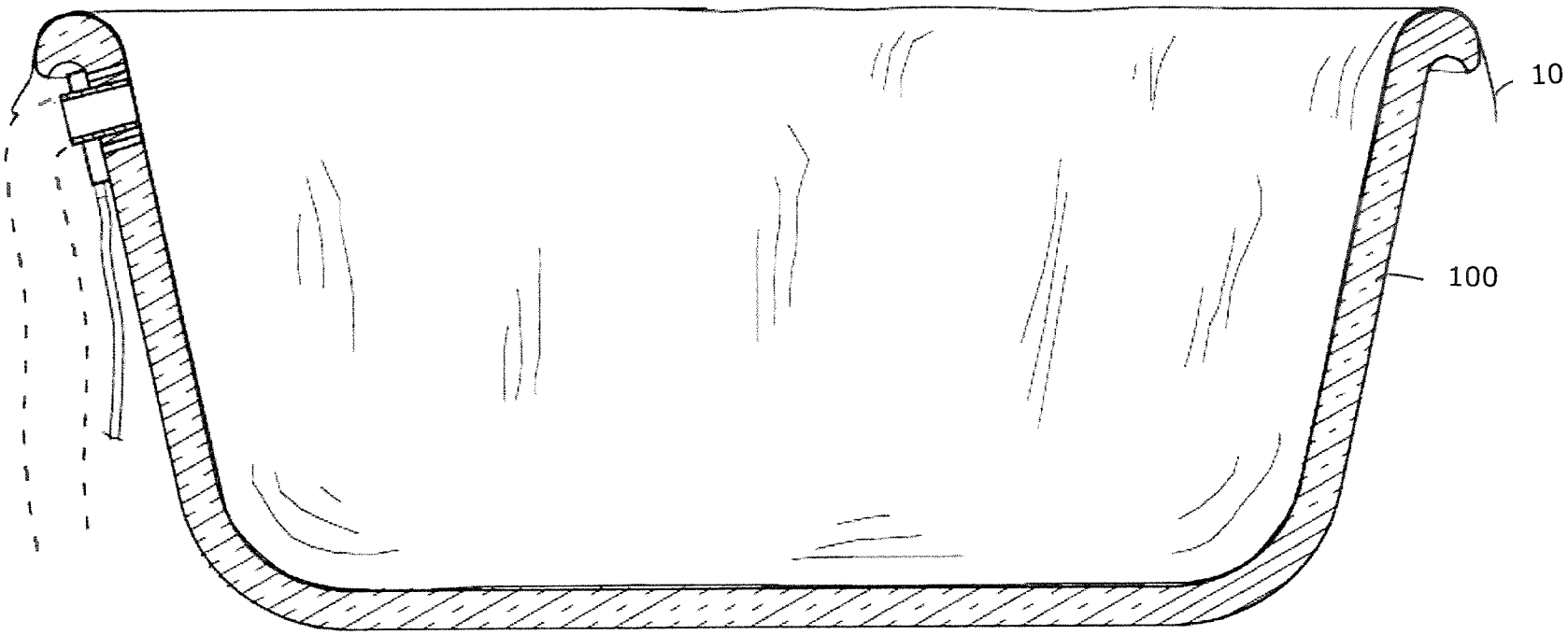
FIG. 19 is a view of the structure of FIG. 18 assembled for use.
Figure 20:
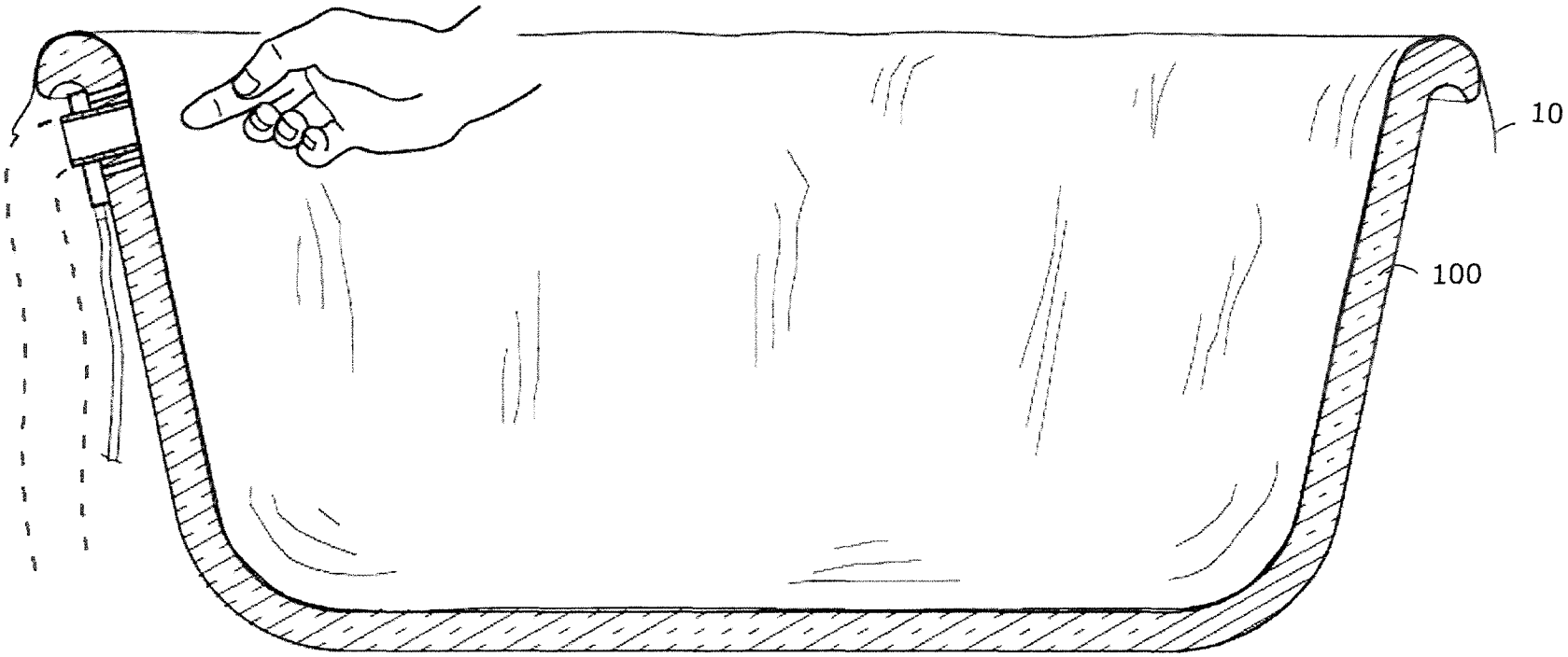
FIG. 20 is a view of the structure of FIG. 19 in the process of being punctured.

In use, the one of the sides is secured to the basin as shown in FIG. 16, the release layer is removed to expose the adhesive layer as shown in FIG. 17, the liner is placed in the basin and placed into contact with the adhesive as indicated by FIGS. 18-19 and the overflow drain is popped with a finger or the like as indicated by FIG. 20.

Whereas three embodiments are shown, variations are possible.

For example, in respect of the third embodiment, the adhesive and release layers could be removed and the suction-cup layer could be formed integrally with a liner.

In respect of the second embodiment, whereas a plurality of holes are shown which communicate with the vacuum, only a single hole could be provided in the basin and a long groove could be formed in a thickened annular portion of the liner, or a labyrinth of fine passages leading to a plurality of holes could be formed in a thickened annular portion of the liner.

In respect of the first embodiment, the tube could be separable from the basin.

Further, whereas specific basins and liners are shown, variations are of course possible, that is, in all embodiments, the basins and liners can take other shapes.

Accordingly, the invention should be understood to be limited only by the accompanying claims, purposively construed.

The invention claimed is:

1. A hygienic foot spa apparatus, the apparatus comprising:

a disposable liner;

a basin adapted to receive the liner, the liner being continuous without premade apertures, the basin having a bottom drain that is covered by the liner, a sidewall and an overflow aperture disposed in the sidewall;

a flangeless cylindrical tube with a constant circumference communicating with the overflow aperture and projecting through the overflow aperture into an interior of the basin; and an annular elastomeric seal adapted to grip and constrict about the liner fitted about an outer circumference of the tube that projects into the interior of the basin and seals the liner about a proximal end of the tube that projects through the overflow aperture.

* * * * *